US010898010B2

(12) United States Patent
Walters

(10) Patent No.: US 10,898,010 B2
(45) Date of Patent: Jan. 26, 2021

(54) SCREW DRIVE FOR DISPENSING CUTLERY AND RELATED METHODS

(75) Inventor: Richard S. Walters, Port Washington, WI (US)

(73) Assignee: GPCP IP Holdings LLC, Atlanta, GA (US)

( * ) Notice: Subject to any disclaimer, the term of this patent is extended or adjusted under 35 U.S.C. 154(b) by 1074 days.

(21) Appl. No.: 13/284,215

(22) Filed: Oct. 28, 2011

(65) Prior Publication Data

US 2012/0145734 A1 Jun. 14, 2012

Related U.S. Application Data

(60) Provisional application No. 61/422,004, filed on Dec. 10, 2010.

(51) Int. Cl.
*A47F 1/10* (2006.01)

(52) U.S. Cl.
CPC ..... *A47F 1/10* (2013.01)

(58) Field of Classification Search
CPC ..... A47J 31/08; A47J 31/007; A47J 31/10; A47J 31/404; A47J 31/4403; G07F 11/045; G07F 11/42; G07F 11/62; G07F 11/44; G07F 11/0092; G07F 13/10; A47K 10/424; A47K 10/421; A47F 2001/103; B65G 59/00; B65G 59/06; B65G 65/10; B65B 43/50
USPC ..... 414/331; 221/36, 6, 197
See application file for complete search history.

(56) References Cited

U.S. PATENT DOCUMENTS

| | | | |
|---|---|---|---|
| 46,832 | A | 3/1865 | Thorne |
| 592,105 | A | 10/1897 | Barnes |
| D32,913 | S | 7/1900 | Graf |
| 703,718 | A | 7/1902 | Cammann |
| 716,058 | A | 12/1902 | Lang et al. |
| 925,485 | A | 2/1909 | Lefler |
| 999,837 | A | 8/1911 | Morris et al. |
| 1,053,387 | A | 2/1913 | Hawley |
| 1,146,447 | A | 7/1915 | Prommel |
| 1,182,793 | A | 5/1916 | Richardson |
| 1,259,927 | A | 3/1918 | Swift |
| 1,261,835 | A | 4/1918 | Martin |
| 1,353,109 | A | 9/1920 | Carr |

(Continued)

FOREIGN PATENT DOCUMENTS

| | | | |
|---|---|---|---|
| CA | 2545745 | A1 | 11/2006 |
| CN | 2865478 | Y | 2/2007 |

(Continued)

OTHER PUBLICATIONS

Peel Adhesion for Single Coated Pressure-Sensitive Tapes 180 Angle, Aug. 1989, pp. 21-22.

(Continued)

*Primary Examiner* — Rakesh Kumar

(57) ABSTRACT

A dispenser for dispensing cutlery may include a housing configured to contain a plurality of utensils for dispensing, a dispensing mechanism that includes at least one threaded separating member configured to be driven and separate a utensil from a stack of utensils, and at least one drive mechanism configured to drive the at least one threaded separating member. The dispenser may further include a receptacle configured to receive the utensil separated from the stack of utensils.

22 Claims, 3 Drawing Sheets

(56) References Cited

U.S. PATENT DOCUMENTS 1,355,583 A 10/1920 Zeidler et al.
1,482,071 A 1/1924 Duff et al.
1,497,585 A 6/1924 Poole
1,504,098 A 8/1924 Cathey
1,546,077 A 7/1925 Hunter et al.
1,547,151 A 7/1925 Watling
1,560,938 A 11/1925 Lund
1,577,302 A 3/1926 Schultz
1,610,001 A 12/1926 Foster
1,635,386 A 7/1927 Pierson
1,675,510 A 7/1928 Nolan
1,767,634 A 6/1930 Weiss
1,821,377 A 9/1931 Cusick
1,886,378 A 11/1932 Dearsley
1,936,057 A 11/1933 Hodge
2,052,505 A 8/1936 Vetrosky
2,053,828 A 9/1936 Harper
2,078,984 A 5/1937 Williamson
2,089,378 A 8/1937 Jenkin
2,110,189 A 3/1938 Zeidler, Sr.
2,141,684 A 12/1938 Diemer
2,149,098 A 2/1939 Phinney
2,149,099 A * 2/1939 Phinney ..... A47F 1/10 221/6
2,160,374 A 5/1939 Veillette
2,184,029 A * 12/1939 Wicklund ..... 414/797.7
2,188,573 A 1/1940 Longo
D119,760 S 4/1940 Kopp
2,207,528 A 7/1940 Witt
2,223,347 A 12/1940 Axthelm
2,239,196 A 4/1941 Lunvik
2,246,852 A 6/1941 Kale
2,260,596 A 10/1941 Young
2,268,596 A 1/1942 Jerum
2,268,873 A * 1/1942 Hopkins ..... 221/242
2,328,486 A 8/1943 Painter
2,340,561 A 2/1944 Renfro
2,421,782 A 6/1947 Gibbs et al.
2,427,321 A 9/1947 Casey et al.
2,433,736 A * 12/1947 Carew ..... 221/222
2,472,051 A 5/1949 Testi
2,497,718 A * 2/1950 Earley et al. ..... 221/6
2,503,741 A 4/1950 Johnson
2,526,136 A 10/1950 Holzknecht
2,571,668 A 10/1951 Booth et al.
2,577,344 A 12/1951 Masure
2,624,093 A 1/1953 Hatch et al.
2,635,025 A 4/1953 Ziska
2,646,874 A 7/1953 Testi
2,651,093 A 9/1953 Lynch
2,671,555 A 3/1954 Shnitzler
2,692,691 A 10/1954 Harriss et al.
2,695,125 A 11/1954 Bowen
2,752,678 A 7/1956 Welch
2,800,013 A 7/1957 George
2,806,634 A 9/1957 Baumgartner
2,843,909 A 7/1958 Eilertsen
2,845,679 A 8/1958 Baruch
2,857,645 A 10/1958 Vogelsang
2,868,344 A 1/1959 Shields
2,870,505 A 1/1959 Hawie
2,877,490 A 3/1959 Greninger
2,877,926 A 3/1959 Abbe
2,880,907 A 4/1959 Mainers
2,889,076 A 6/1959 Van Schie
2,911,127 A 11/1959 Driss et al.
2,924,357 A 2/1960 Kingsley et al.
2,946,431 A 7/1960 Nissen
2,946,481 A * 7/1960 Carew ..... 221/222
2,953,170 A 9/1960 Bush
2,954,948 A 10/1960 Johnson
2,965,262 A 12/1960 Du Bois
3,037,257 A 6/1962 Girodet
3,052,006 A 9/1962 Jonas
3,054,528 A 9/1962 Loomis
3,083,879 A 4/1963 Coleman
3,095,114 A 6/1963 Tobias
3,100,842 A 8/1963 Tellefsen
3,114,475 A 12/1963 Etes
3,116,152 A 12/1963 Smith
3,132,765 A 5/1964 Florendo
3,146,908 A 9/1964 Perri et al.
3,163,327 A 12/1964 Maxwell
3,180,489 A 4/1965 McGinn
3,182,345 A 5/1965 Smith
3,263,860 A 8/1966 Haas
3,279,652 A * 10/1966 Willvonseder ..... 221/223
3,300,087 A 1/1967 Kuypers
3,310,271 A 3/1967 King
3,313,452 A 4/1967 Katz
3,334,784 A 8/1967 Morrison
3,338,471 A 8/1967 De Good
3,371,821 A 3/1968 Abood, Jr. et al.
3,383,018 A 5/1968 Grimsley
3,400,435 A 9/1968 Akesson-Rydin
3,402,441 A 9/1968 Woskin
3,407,927 A 10/1968 Jones
3,408,708 A 11/1968 Hawie
3,426,941 A 2/1969 Hovekamp
3,435,491 A 4/1969 Shears
3,472,421 A 10/1969 Baller
3,499,538 A 3/1970 Sherard
3,558,006 A 1/1971 Redmond et al.
3,587,922 A 6/1971 Oriti
3,654,396 A 4/1972 Biezeveld
3,680,736 A 8/1972 Viessmann
3,710,535 A 1/1973 Walter
3,741,410 A * 6/1973 Henschke et al. ..... 414/795.6
3,747,803 A 7/1973 Zoepf et al.
3,786,959 A 1/1974 Greb et al.
3,851,762 A 12/1974 Liblick
3,861,563 A 1/1975 Lisbin
3,862,702 A * 1/1975 Johnson ..... B65G 59/108 221/1
3,897,886 A 8/1975 Franklin
3,932,978 A * 1/1976 Kinney ..... 53/471
3,972,118 A 8/1976 Richard
3,987,901 A 10/1976 Dullinger
4,043,203 A 8/1977 Montesi
4,048,915 A * 9/1977 Martin ..... 101/35
4,091,915 A 5/1978 Claasen
4,120,662 A * 10/1978 Fosslien ..... G01N 35/04 422/561
4,134,519 A 1/1979 Barnett et al.
4,146,123 A 3/1979 Cottrell
4,271,999 A 6/1981 Stravitz
4,288,003 A * 9/1981 Fries, Jr. ..... 221/1
4,308,974 A 1/1982 Jones
4,317,284 A 3/1982 Prindle
4,489,854 A 12/1984 Wenkman et al.
4,524,512 A 6/1985 Formo et al.
4,570,536 A 2/1986 Dodd
4,571,773 A 2/1986 Yuda
4,574,423 A 3/1986 Ito et al.
D284,442 S 7/1986 Chan
4,601,386 A * 7/1986 Antonello ..... 198/576
4,610,087 A 9/1986 Mickelson et al.
4,614,004 A 9/1986 Oshida
4,662,536 A 5/1987 Powers
4,666,060 A * 5/1987 Bouldin ..... 221/11
4,691,811 A 9/1987 Arakawa et al.
4,697,673 A 10/1987 Omata
4,707,251 A 11/1987 Jenkins
4,715,514 A 12/1987 Vidondo
4,789,064 A 12/1988 Segal
4,835,864 A 6/1989 Tang
4,863,033 A 9/1989 Buj
D305,709 S 1/1990 Blignaut
4,896,792 A 1/1990 Marchand
4,915,578 A 4/1990 Becker
4,921,106 A 5/1990 Spatafora et al.
4,950,120 A * 8/1990 Barnes ..... 414/331.12
4,961,684 A * 10/1990 Provan ..... B65G 59/108 221/222

(56) References Cited

U.S. PATENT DOCUMENTS 4,963,072 A 10/1990 Miley et al.
4,973,037 A 11/1990 Holbrook
4,986,442 A 1/1991 Hinterreiter
4,995,154 A 2/1991 Bamber
D318,600 S 7/1991 Lillelund et al.
5,064,093 A * 11/1991 Davis ..... B65G 59/108 221/222
5,080,257 A 1/1992 Carnisio
5,127,546 A 7/1992 Chen
5,131,586 A 7/1992 Capy
5,161,268 A 11/1992 Harrow
5,176,494 A 1/1993 Nigrelli et al.
5,191,997 A 3/1993 Squitieri
5,211,267 A 5/1993 Clark
5,249,705 A 10/1993 Gates
D342,648 S 12/1993 Cautereels et al.
5,269,397 A 12/1993 Kawamoto et al.
5,327,650 A 7/1994 Rojas
D351,085 S 10/1994 Schmidt
5,364,016 A 11/1994 Capy et al.
5,413,317 A 5/1995 Spoerre
D362,160 S 9/1995 Brabeck et al.
5,449,054 A 9/1995 Wiese et al.
5,460,252 A 10/1995 Kosugi et al.
5,469,688 A 11/1995 Dunbar et al.
5,479,708 A 1/1996 Thomas
5,497,863 A 3/1996 Schmidt et al.
5,509,522 A 4/1996 Laidlaw
5,518,149 A * 5/1996 Lotspeich et al. ..... 221/222
5,542,508 A 8/1996 Van Erden et al.
5,564,594 A 10/1996 Monfredo
5,586,685 A 12/1996 Dorner et al.
5,590,472 A 1/1997 Yaakov
5,605,208 A 2/1997 Friedrichsen et al.
5,660,252 A 8/1997 Lafon
5,762,211 A 6/1998 Ensign
5,845,403 A 12/1998 Nivin
5,853,092 A 12/1998 Goodman et al.
5,904,250 A * 5/1999 De Schutter ..... 206/553
5,921,408 A 7/1999 Groenewold et al.
5,933,918 A 8/1999 Wallays
5,950,842 A 9/1999 Bauer
5,961,021 A 10/1999 Koike et al.
D420,887 S 2/2000 Chen
6,023,913 A 2/2000 Gray et al.
D422,431 S 4/2000 Goins
6,047,830 A 4/2000 Chang
6,085,916 A 7/2000 Kovacevic et al.
6,098,379 A * 8/2000 Spatafora ..... B65B 35/04 414/788.9
6,115,921 A 9/2000 Garneau
6,134,790 A 10/2000 Watson
6,202,891 B1 3/2001 Mark
6,226,845 B1 5/2001 Fink
6,250,498 B1 6/2001 Lovejoy
6,289,889 B1 9/2001 Bell et al.
6,298,960 B1 10/2001 Derr
6,378,729 B1 4/2002 Kodama
D458,070 S 6/2002 Bennett et al.
6,399,079 B1 6/2002 Mehta et al.
6,412,398 B1 7/2002 Norcross et al.
6,415,465 B1 7/2002 Harrow
6,575,313 B1 6/2003 Chen
6,626,633 B2 9/2003 Jendzurski et al.
6,651,841 B2 11/2003 Tsuchida
6,749,074 B1 6/2004 Hileman et al.
D492,549 S 7/2004 Welch
D493,337 S 7/2004 Welch
6,763,972 B2 7/2004 Graupner
6,786,357 B2 7/2004 Renard
6,786,359 B1 9/2004 Schroeder
6,832,694 B2 12/2004 Goeking et al.
6,832,698 B1 12/2004 Dybul
6,837,028 B1 1/2005 Miano et al.
6,840,353 B2 1/2005 Arisaka
6,840,420 B1 1/2005 Hudson
6,863,173 B2 3/2005 Bennett
6,880,211 B2 4/2005 Jackson et al.
6,895,672 B2 5/2005 Conforti
6,945,427 B2 9/2005 Hieb
6,972,033 B2 12/2005 McNicholas
6,976,348 B1 12/2005 Miano et al.
7,013,568 B2 3/2006 Schmidt
7,076,932 B2 7/2006 Rubin
7,090,455 B2 8/2006 Lamb
7,111,369 B2 9/2006 Ho
D533,034 S 12/2006 Wasserman
7,156,220 B2 1/2007 Olson et al.
D536,222 S 2/2007 Heiberg et al.
7,210,279 B1 5/2007 Ahmed et al.
7,322,172 B2 1/2008 Hoffman et al.
D564,819 S 3/2008 Fosburg et al.
7,412,808 B2 8/2008 Lavi
D591,104 S 4/2009 Oakes
7,513,089 B2 4/2009 Rubin
7,516,831 B2 4/2009 Chang
7,520,247 B2 4/2009 Rutledge
7,669,256 B2 3/2010 Harrow
7,716,842 B2 5/2010 Sumner-Trivisani et al.
7,731,899 B2 * 6/2010 Talmer ..... B01L 9/06 422/64
7,819,234 B2 10/2010 Herzog
7,856,722 B2 12/2010 Lago-Arenas
8,070,013 B2 12/2011 Reinsel et al.
8,152,004 B2 4/2012 Smith et al.
8,210,364 B2 * 7/2012 Smith et al. ..... 211/70.7
8,272,533 B1 9/2012 D'Amelia
8,296,957 B2 10/2012 Muehlemann
8,297,473 B2 10/2012 Smith
8,302,269 B2 11/2012 Pitman
8,360,273 B2 1/2013 Reinsel et al.
8,480,954 B2 * 7/2013 Talmer ..... G01N 35/00029 422/63
9,439,518 B2 9/2016 Oakes
9,560,920 B2 2/2017 Oakes
D783,303 S 4/2017 Roche
D788,485 S 6/2017 Greenwald et al.
2002/0112445 A1 8/2002 Scaduto
2003/0015824 A1 1/2003 Forbes et al.
2003/0146061 A1 8/2003 Tournier
2004/0045398 A1 3/2004 Hayashi
2004/0045860 A1 3/2004 Edgerly et al.
2004/0089670 A1 5/2004 Goeking et al.
2004/0237311 A1 12/2004 Brown et al.
2005/0034310 A1 2/2005 Conforti
2005/0082307 A1 4/2005 Tucker
2005/0155186 A1 7/2005 McGuyer et al.
2005/0155229 A1 7/2005 Lee
2005/0224531 A1 10/2005 Bulovic
2005/0252057 A1 11/2005 Lavi
2006/0000190 A1 1/2006 Behnke et al.
2006/0053638 A1 3/2006 Sumner-Trivisani et al.
2006/0218795 A1 10/2006 Santa Cruz et al.
2007/0035943 A1 2/2007 Wang
2007/0108141 A1 5/2007 Smith et al.
2007/0131705 A1 6/2007 Behravesh et al.
2007/0193968 A1 8/2007 Smith et al.
2007/0214650 A1 9/2007 Tomazini
2007/0250391 A1 10/2007 Prade et al.
2008/0121650 A1 5/2008 Smith
2008/0128445 A1 6/2008 Huang et al.
2009/0194557 A1 8/2009 Van Deursen
2010/0000096 A1 1/2010 Muehlemann
2010/0084418 A1 4/2010 Reinsel et al.
2010/0147869 A1 6/2010 Iliffe et al.
2010/0170915 A1 7/2010 Reinsel et al.
2011/0180562 A1 7/2011 Reinsel et al.
2011/0226797 A1 9/2011 Reinsel et al.
2011/0266300 A1 11/2011 Schwarzli
2011/0296693 A1 * 12/2011 Oakes ..... A47G 21/06 30/142
2012/0036724 A1 2/2012 Walters
2012/0047744 A1 3/2012 Walters

(56) References Cited

U.S. PATENT DOCUMENTS

| | | | | |
|---|---|---|---|---|
| 2012/0080444 | A1* | 4/2012 | Smith | A47F 1/10 221/208 |
| 2012/0110746 | A1 | 5/2012 | Serrano et al. | |
| 2012/0145734 | A1* | 6/2012 | Walters | A47F 1/10 221/1 |
| 2012/0145735 | A1 | 6/2012 | Erickson et al. | |
| 2012/0145736 | A1 | 6/2012 | Walters et al. | |
| 2013/0032609 | A1 | 2/2013 | Righetti et al. | |
| 2013/0043272 | A1 | 2/2013 | Oakes | |
| 2013/0134211 | A1 | 5/2013 | Linkel | |
| 2013/0152406 | A1 | 6/2013 | McFarland | |
| 2013/0193157 | A1 | 8/2013 | Jongen et al. | |
| 2014/0069930 | A1 | 3/2014 | Oakes | |
| 2014/0191024 | A1 | 7/2014 | Wnek et al. | |
| 2014/0217112 | A1 | 8/2014 | Young et al. | |
| 2015/0001235 | A9 | 1/2015 | Smith | |

FOREIGN PATENT DOCUMENTS

| | | | |
|---|---|---|---|
| CN | 101495015 | A | 7/2009 |
| DE | 7033238 | U1 | 11/1970 |
| DE | 7127677 | U | 11/1971 |
| DE | 3151268 | | 7/1983 |
| DE | 4139938 | | 6/1993 |
| DE | 9316566 | | 1/1994 |
| DE | 19906369 | | 2/2000 |
| DE | 202005013647 | U1 | 7/2006 |
| EP | 0257109 | A1 | 8/1986 |
| EP | 0856272 | A2 | 1/1999 |
| EP | 1022107 | A1 | 7/2000 |
| EP | 1217923 | B1 | 9/2003 |
| EP | 1358827 | A3 | 11/2003 |
| EP | 1213985 | B1 | 6/2004 |
| EP | 1514497 | A1 | 3/2005 |
| EP | 1719438 | A1 | 11/2006 |
| EP | 1864596 | A2 | 12/2007 |
| FR | 2889507 | A1 | 2/2007 |
| JP | H06121727 | A | 5/1994 |
| JP | 08-047440 | A | 2/1996 |
| JP | 2007-319493 | A | 12/2007 |
| KR | 20-1991-0008085 | Y1 | 10/1991 |
| KR | 10-2009-0071515 | A | 7/2009 |
| TW | M293720 | U | 7/2006 |
| WO | 01/05280 | A1 | 1/2001 |
| WO | 01/05281 | A1 | 1/2001 |
| WO | 01/68492 | A1 | 9/2001 |
| WO | 2004/028309 | A1 | 4/2004 |
| WO | 2007/049982 | A1 | 5/2007 |
| WO | 2007/012606 | A1 | 11/2007 |
| WO | 2008/058187 | A2 | 5/2008 |
| WO | 2009137367 | A2 | 11/2009 |

OTHER PUBLICATIONS

Tack Rolling Ball, Aug. 1989, pp. 29-30.

Holding Power of Pressure-Sensitive Tape, Aug. 1989, pp. 31-33.

European Patent Report 06009258.2, dated Jul. 24, 2006, five pages, Munich, Germany.

International Search Report and Written Opinion for PCT/US07/83752, dated Mar. 11, 2008, ten pages, European Patent Office, Munich, Germany.

Partial International Search Report for PCT/US2007/083922, dated Jul. 8, 2008, two pages.

European Search Report for EP 08 014 387.8 dated Nov. 11, 2008, two pages, European Patent Office, Munich, Germany.

International Search Report and Written Opinion for PCT/US2007/083922, dated Nov. 17, 2008, 13 pages, European Patent Office, Rijswijk, Netherlands.

International Search Report and Written Opinion for PCT/US2009/059915, dated Feb. 3, 2010, 13 pages, European Patent Office, Munich, Germany.

Office Actions for U.S. Appl. No. 11/556,808, filed Nov. 6, 2006.

Office Actions for U.S. Appl. No. 11/415,836, filed May 2, 2006.

Office Actions for U.S. Appl. No. 11/936,401, filed Nov. 7, 2007.

Office Action for U.S. Appl. No. 12/349,203, filed Jan. 6, 2009.

International Search Report and Written Opinion of the International Search Authority for PCT/US2011/058329 dated Feb. 29, 2012.

Supplementary European Search Report dated Sep. 25, 2013 for Application No. 11793088.3.

International Search Report and Written Opinion for PCT/US2011/044931, dated Feb. 28, 2012.

International Search Report and Written Opinion for PCT/US2011/044934, dated Mar. 6, 2012.

International Search Report and Written Opinion for PCT/US2011/058767, dated Feb. 29, 2012.

International Search Report and Written Opinion for PCT/US2011/064057, dated Feb. 29, 2012.

International Search Report for International Application No. PCT/US2010/000051, mailed by the International Searching Authority dated Aug. 16, 2010.

Written Opinion for International Application No. PCT/US2010/000051, mailed by the International Searching Authority dated Aug. 16, 2010.

* cited by examiner

SCREW DRIVE FOR DISPENSING CUTLERY AND RELATED METHODS

CROSS-REFERENCE TO RELATED APPLICATION

This application claims priority to U.S. Provisional Patent Application No. 61/422,004 filed Dec. 10, 2010, the disclosure of which is incorporated herein in its entirety by this reference.

FIELD OF THE DISCLOSURE

The present disclosure relates to dispensing cutlery. In particular, the present disclosure relates to dispensers for dispensing utensils, dispensing mechanisms for dispensing utensils, and related methods.

BACKGROUND

Disposable cutlery may be provided as a less expensive alternative to reusable cutlery, for example, at restaurants and social gatherings where it is undesirable or cost prohibitive to clean the cutlery for reuse. However, providing disposable cutlery may present a number of potential drawbacks related to the nature in which it is dispensed.

For example, providing disposable cutlery in a loose or unpackaged fashion, such as in loose form in a receptacle containing the disposable cutlery, may result in patrons taking more cutlery than necessary, thereby increasing the cost of providing the cutlery. In addition, providing loose or unpackaged cutlery may present concerns regarding whether dispensing cutlery in such a manner is hygienic. As a result, it may be desirable to dispense disposable cutlery in a manner other than in a loose or unpackaged form.

The above-noted concerns may be addressed by dispensing disposable cutlery from dispensers configured to contain a supply of the cutlery and dispense a disposable utensil upon operation of a patron. However, the complexity and expense of many dispensers may reduce the benefit to the purchaser of the dispenser. Thus, it may be desirable to provide a simple and reliable dispenser in order to further reduce costs and increase efficiency.

In addition, it may be desirable to provide a dispenser that is capable of dispensing utensils without flipping or otherwise altering the orientation of the utensils during the dispensing process. For example, some dispensers may cause utensils to flip or rotate within the dispenser as a stack of the utensils slides within the dispenser, which may lead to jamming the dispenser, thereby potentially compromising its utility.

Additionally, it may be desirable to provide a dispenser capable of reliably dispensing utensils. Dispensers that lack a reliable dispensing mechanism may have a tendency to cause patrons to unintentionally dispense more than one utensil at a time and/or jam the dispenser such that no utensils can be dispensed until the dispenser is manually un-jammed. This may result in compromising one of the potential advantages of dispensing utensils via a dispenser—reducing costs associated with patrons taking more utensils than necessary.

Thus, it is desirable to provide a system and method for addressing one or more of the potential drawbacks discussed above.

SUMMARY

In the following description, certain aspects and embodiments will become evident. It should be understood that the aspects and embodiments, in their broadest sense, could be practiced without having one or more features of these aspects and embodiments. Thus, it should be understood that these aspects and embodiments are merely exemplary.

One aspect of the disclosure relates to a dispenser for dispensing cutlery. The dispenser may include a housing configured to contain a plurality of utensils for dispensing, a dispensing mechanism that includes at least one threaded separating member configured to be driven and separate a utensil from a stack of utensils, and at least one drive mechanism configured to drive the at least one threaded separating member. According to some embodiments, the at least one threaded separating member may interact with the shape of the utensil. For example, the positioning of the at least one threaded separated members may depend on the shape of the utensil rather than the location of other threaded separating members. The dispenser may further include a receptacle configured to receive the utensil separated from the stack of utensils. As used herein, "stack" does not necessarily mean a vertical stack, such that a group of nested, coupled, or similarly oriented utensils may extend at any angle ranging from horizontal to vertical.

Another aspect relates to a method for dispensing cutlery from a dispenser. The method may include providing a plurality of utensils for dispensing, indexing at least one threaded separating member such that a utensil is separated from the stack of utensils, and providing access to the utensil separated from the stack of utensils.

BRIEF DESCRIPTION OF THE DRAWINGS

The accompanying drawings, which are incorporated in and constitute a part of this description, illustrate several embodiments and together with the description, serve to explain principles of the embodiments. In the drawings.

DETAILED DESCRIPTION OF EMBODIMENTS

Figure 1:
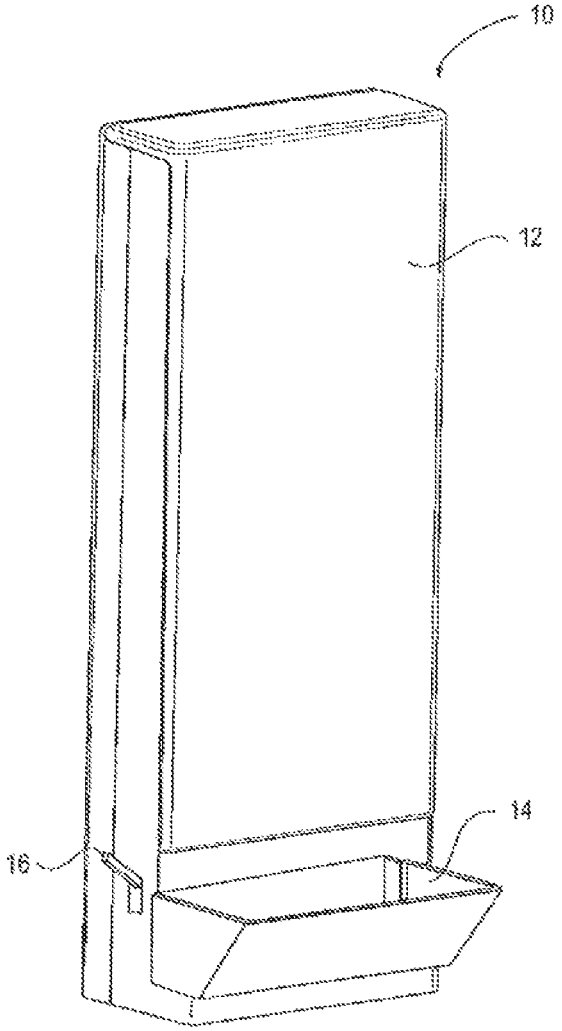
FIG. 1 is a schematic perspective view of an embodiment of a dispenser for dispensing utensils.

Reference will now be made in detail to various embodiments. Wherever possible, the same reference numbers are used in the drawings and the description to refer to the same or like parts.

FIG. 1 shows a schematic perspective view of a dispenser 10 for dispensing utensils 20. Dispenser 10 includes a housing 12 configured to store a plurality of utensils 20 (see FIGS. 2 and 3). Housing 12 may be configured to receive utensils 20 in various arrangements. For example, housing 12 may be configured to receive one or more of loose utensils, cartridges containing utensils, stacks of utensils bound by a wrapper, and/or stacks of utensils removably coupled to one another. For example, housing 12 may include a chute configured to receive a plurality of utensils 20 in a stack 21. The chute of housing 12 may feed a dispensing mechanism 18 (see, e.g., FIGS. 2 and 3), which is configured to dispense at least one utensil 20, for example, individually. According to some embodiments, the stack 21 of utensils 20 may extend at any angle ranging from horizontal to vertical.

Dispenser 10 includes a receptacle 14 configured to receive utensils 20 dispensed from housing 12 by a dispensing mechanism 18. Dispensing mechanism 18 may be located inside dispenser 10. In some embodiments, dispensing mechanism 18 is located inside housing 12. Dispenser 10 may include an actuator 16 for operation of dispenser 10 by a user. Actuator 16 may be configured to activate dispensing mechanism 18 in order to dispense a utensil 20 from a stack 21 of utensils in housing 12. While FIG. 1 shows actuator 16 in the form of a handle, actuator 16 may be provided in any suitable form, for example, a rotatable knob, a button, a switch, a bar, an electronic sensor (e.g., a proximity sensor), and/or a crank. Additionally, according to some embodiments, actuator 16 may be incorporated into other aspects of dispenser 10. For example, actuator 16 may be incorporated into receptacle 14, such that a user may activate actuator 16 by manipulating receptacle 14 directly in order to operate dispensing mechanism 18. In some embodiments, actuator 16 may be incorporated into other aspects of dispenser 10, such as, for example, housing 12.

Figure 2:
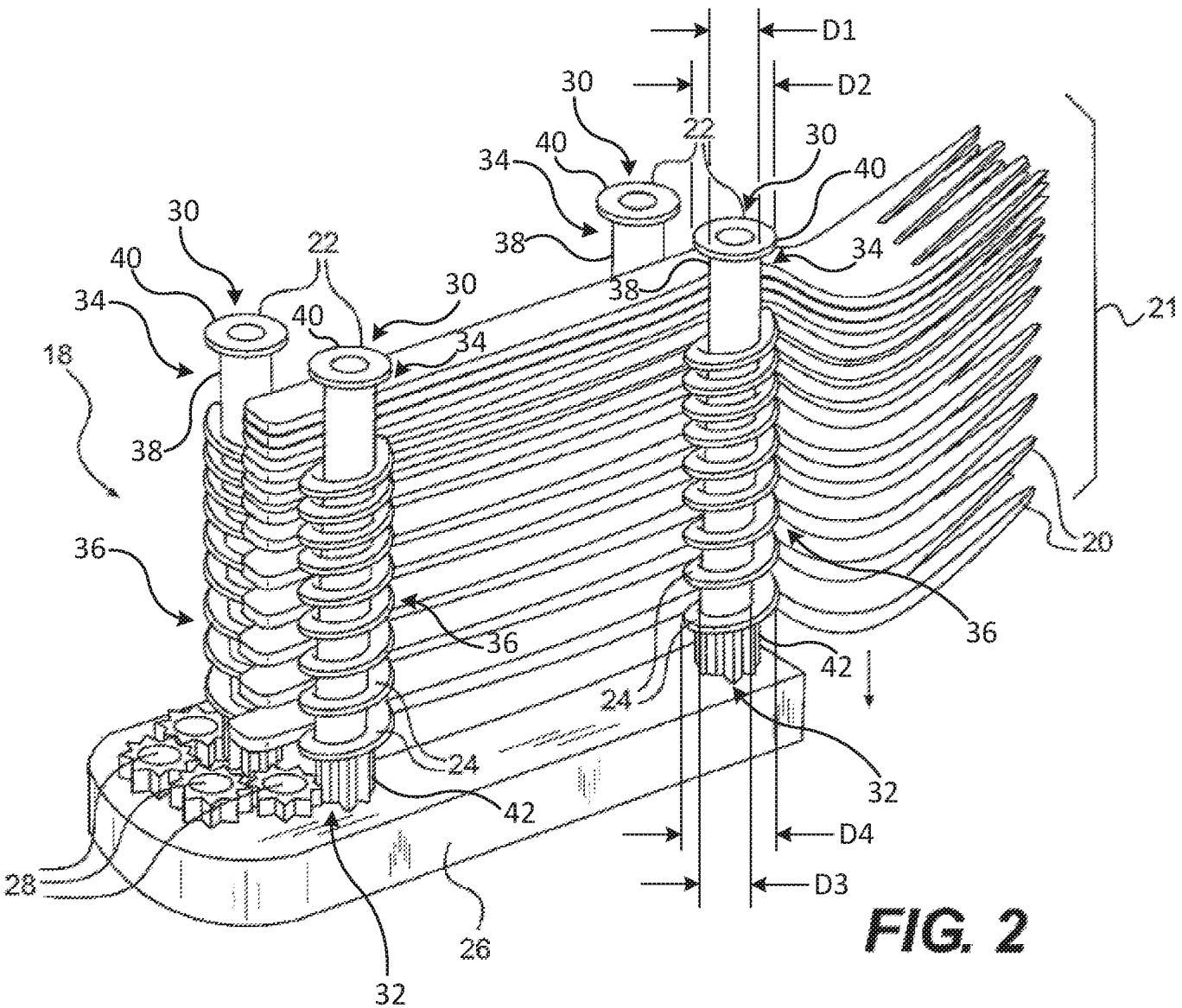
FIG. 2 is a schematic perspective view of a dispensing mechanism and a stack of utensils.

FIG. 2 shows a schematic perspective view of dispensing mechanism 18 and a stack 21 of utensils. Utensils 20 are shown as forks, but may be provided in any suitable form, for example, spoons, knives, and/or sporks. In some embodiments, utensils 20 may have variable cross-sectional shapes, such that, for example, the portion of utensil 20 that is anticipated to contact dispensing mechanism 18 may be shaped to facilitate dispensing (e.g., it may have a handle portion that is generally consistent in cross-sectional shape over a portion of utensil 20), while other portions of utensil 20 may have different cross-sectional shapes. Utensils 20 may be constructed from a formable material. The formable material may include, for example, plastic, combinations of plastics, or combinations of plastics and other materials suitable for use as disposable or reusable cutlery. For example, the formable material may include one or more of polystyrene, polyethylene, and polypropylene.

According to some embodiments, dispensing mechanism 18 may facilitate the dispensing of utensils 20 from a stack 21 of utensils. In particular, dispensing mechanism 18 may be configured to retain a plurality of utensils 20 inside housing 12 until a user operates actuator 16 of dispenser 10. During operation in one embodiment, dispensing mechanism 18 may separate at least one utensil 20 from a stack 21 of utensils and allow the at least one utensil 20 to proceed, for example, via gravity, from dispensing mechanism 18 to receptacle 14, where it may be received by a user. In some embodiments, dispensing mechanism 18 may be operated via actuator 16. For example, a user may operate actuator 16 in a downward direction in order to operate dispensing mechanism 18 and dispense utensil 20. The method of operating actuator 16 in order to operate dispensing mechanism 18 may depend on the form of actuator 16, which may be provided in any suitable form, for example, a rotatable knob, a button, a switch, a bar, an electronic sensor, and/or a crank.

Dispensing mechanism 18 of FIG. 2 is shown with two pairs of threaded separating members 22 associated with a stack 21 of utensils with the two pairs of threaded separating members 22 being spaced from one another along the longitudinal length of the utensils 20. According to some embodiments, threaded separating member 22 may include external threading 24 that at least partially surrounds a portion of threaded separating member 22. For example, the threaded separating member 22 of FIG. 2 includes external threading 24 that partially surrounds a lower portion of threaded separating member 22. In some embodiments, threaded separating member 22 may engage at least one utensil 20 via at least a portion of external threading 24. For example, a portion of external threading 24 may be configured to engage the stack 21 of utensils by being located between individual utensils 20. According to some embodiments, at least a portion of threaded separating member 22 may be configured to support a portion of the stack 21 of utensils without engaging that portion of the stack 21 of utensils via external threading 24. For example, as shown in FIG. 2, an upper portion of threaded separating members 22 that lacks external threading 24 may support a portion of the stack 21 of utensils by abutting at least one utensil 20. Although dispensing mechanism 18 is shown with two pairs of threaded separating members 22 in FIG. 2, dispensing mechanism 18 may use any suitable number of threaded separating members 22, including one. For example, stack 21 may abut a surface on one side, allowing threaded separating member 22 to dispense utensils 20 from the stack 21. As shown in FIG. 2, threaded separating member 22 may include a top end 30, a bottom end 32 positioned opposite the top end 30, an unthreaded portion 34 extending from the top end 30 toward the bottom end 32, and a threaded portion 36 extending from the unthreaded portion 34 toward the bottom end 32. As shown in FIG. 2, the unthreaded portion 34 may include a cylindrical body 38 and a circumferential flange 40 projecting from the cylindrical body 38, with the cylindrical body 38 having a first diameter D1 and the circumferential flange 40 having a second diameter D2 greater than the first diameter D1. As shown in FIG. 2, the threaded portion 36 may include external helical threads of the external threading 24, with the threaded portion 36 having a minor diameter D3 equal to the first diameter D1 and a major diameter D4 greater than the first diameter D1. As shown in FIG. 2, threaded separating member 22 also may include a gear 42 positioned between the threaded portion 36 and the bottom end 32.

According to some embodiments, threaded separating members 22 may operate in pairs. For example, a pair of threaded separating members 22 may be positioned such that the stack of utensils may be received between the pair of threaded separating members 22. In some embodiments, dispensing mechanism 18 may operate more efficiently when pairs of threaded separating members 22 rotate at a substantially similar rate.

According to some embodiments, a drive mechanism 26 may be operably coupled to one or more threaded separating members 22, such that the one or more threaded separating members 22 may be driven. For example, drive mechanism 26 may be operably coupled to at least one threaded separating member 22 via at least one gear 28 operably coupled to drive mechanism 26 and the at least one threaded separating member 22. For example, FIG. 2 shows drive mechanism 26 associated with four gears 28 that may operate to rotate at least one pair of threaded separating members 22 at similar speeds. In some embodiments, additional drive mechanisms 26 or additional gears 28 may be associated with the threaded separating members 22 shown in FIG. 2, or with additional threaded separating members 22. In some embodiments, gears 28 may allow multiple pairs of threaded separating members 22 to rotate at a substantially similar speed, thereby providing a desired operation of dispensing mechanism 18.

Drive mechanism 26 may comprise any type of mechanism that transfers force to gears 28 via actuation of actuator 16. According to some embodiments, drive mechanism 26 may include an electric motor associated with actuator 16, for example, an actuator in the form of a proximity sensor. Alternatively, actuator 16 may directly index at least one gear 28. According to some embodiments, drive mechanism 26 may include manual operation by a user, such as, for example, rotation of a knob operably coupled to at least one gear 28.

According to some embodiments, dispensing mechanism 18 may separate utensil 20 from a stack of utensils by driving and/or indexing threaded separating members 22. For example, drive mechanism 26 may rotate at least one threaded separating member 22 such that external threading 24 imparts force to at least one utensil 20 engaged by external threading 24. The direction of the rotation of threaded separating member 22 may determine the direction and/or magnitude of the force applied to an engaged utensil 20. For example, threaded separating members 22 may rotate in a direction that produces a force causing at least one engaged utensil 20 to move in a dispensing direction.

Figure 3:
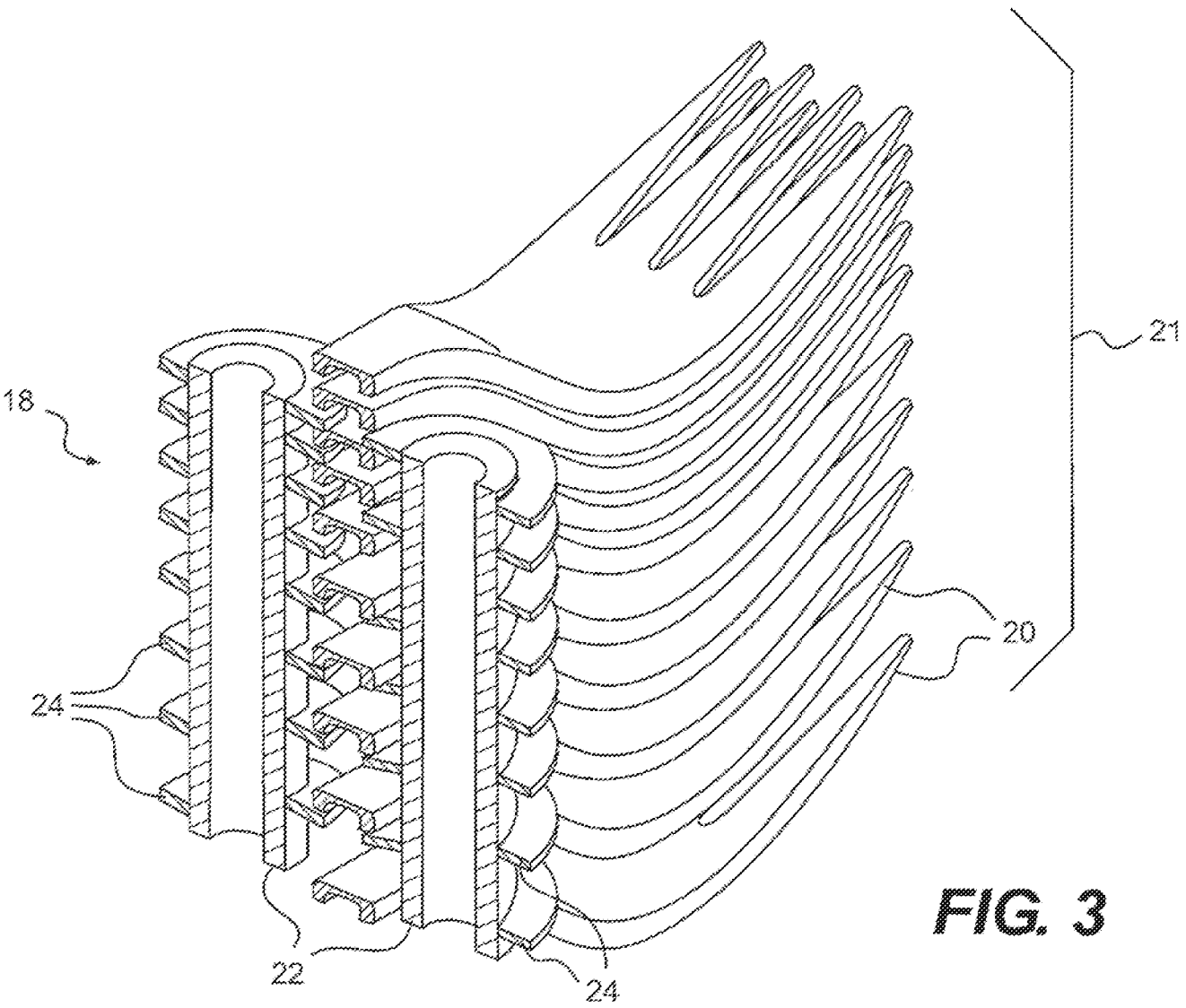
FIG. 3 is a schematic partial perspective cross-sectional view of a dispensing mechanism and a stack of utensils.

In some embodiments, for example, the embodiment shown in FIG. 3, threaded separating members 22 may be configured such that the distance between adjacent external threads of external threading 24 varies over at least a portion of the threaded separating member 22. For example, the distance between adjacent external threads may gradually increase toward at least one end (e.g., the lower end) of threaded separating member 22 that dispenses utensil 20. According to some embodiments, gradually increasing distance between adjacent external threads of threaded separating members 22 may provide a desired amount of separation between utensils 20 that are to be dispensed, thereby preventing unwanted flipping or twisting of utensils 20 and/or enabling pulling apart of separably coupled utensils 20 in a controlled manner. For example, the stack 21 of utensils 20 may include separably coupled utensils 20 that are coupled by use of adhesive, spot welding, ultrasonic welding, vibration welding, soldering, hot melting, or any other suitable method. According to some embodiments, threaded separating members 22 may be configured such that external threading 24 terminates at a location where dispensing of utensil 20 from dispensing mechanism 18 is desired. After being dispensed by dispensing mechanism 18, utensil 20 may proceed to receptacle 14 (e.g., via gravity) to be received by a user.

According to some embodiments, dispensing mechanism 18 may be configured to dispense a stack 21 of utensils in an orientation other than the orientation shown in FIG. 2 (e.g., an orientation that is not a vertical orientation). For example, dispensing mechanism 18 may be configured to dispense utensils 20 from a stack 21 of utensils in a second orientation (i.e., a horizontal orientation). In some embodiments, dispensing mechanism 18 may include one or more threaded separating members 22 on only one side of the stack 21 of utensils. This orientation may be useful where, for example, the stack 21 of utensils rests on a support surface (e.g., a vertically-oriented surface, a horizontally-oriented surface, or a surface disposed at any angle in between vertical and horizontal) with one side of the stack 21 of utensils contacting the support surface. In such circumstances, a single threaded separating member 22 may be configured to dispense utensil 20 from the stack 21 of utensils. This orientation may be useful for dispensers that utilize less vertical space relative to some traditional, upright utensil dispensers.

In some embodiments, utensils 20 may be provided in the form of a cartridge or similar container. For example, a cartridge configured to be loaded into dispenser 10 may contain a stack 21 of utensils configured to be dispensed by dispensing mechanism 18. According to some embodiments, the cartridge may be shaped such that it exposes at least the portions of utensils 20 configured to come into contact with at least one threaded separating member 22. In some embodiments, the cartridge may include a first portion of threaded separating member 22, such that when the cartridge is loaded into dispenser 10 the first portion of the at least one threaded separating member 22 may be associated with at least one drive mechanism 26 and/or a second portion of at least one threaded separating member 22. For example, the first portion of the at least one threaded separating member 22 may include a portion of threaded separating member 22 without external threading 24, while the second portion of the at least one threaded separating member 22 may include external threading 24. In such an example, the portions of threaded separating member 22 may be associated with one another upon loading of the cartridge into dispenser 10. In some embodiments, the cartridge may be used to load and/or aid in loading utensils 20 and may then be removed prior to operation of dispenser 10.

It will be apparent to those skilled in the art that various modifications and variations can be made to the structures and methodologies described herein. Thus, it should be understood that the invention is not limited to the subject matter discussed in the description. Rather, the present disclosure is intended to cover modifications and variations.

What is claimed is:

1. A dispenser for dispensing cutlery, the dispenser comprising:
- a housing configured to contain a plurality of cutlery utensils for dispensing;
- a dispensing mechanism comprising:
  - at least one separating member configured to separate a cutlery utensil from a stack of cutlery utensils, the at least one separating member comprising:
    - a top end;
    - a bottom end positioned opposite the top end;
    - an unthreaded portion extending from the top end toward the bottom end and comprising a cylindrical body configured to extend along one or more first cutlery utensils of the stack of cutlery utensils and a circumferential flange projecting from the cylindrical body, the cylindrical body having a first diameter, and the circumferential flange having a second diameter greater than the first diameter; and
    - a threaded portion extending from the unthreaded portion toward the bottom end and comprising at least one external helical thread configured to engage one or more second cutlery utensils of the stack of cutlery utensils, the threaded portion having a minor diameter equal to the first diameter and a major diameter greater than the first diameter; and
  - a drive mechanism associated with the at least one separating member and configured to drive the at least one separating member; and
- a receptacle configured to receive the cutlery utensil separated from the stack of cutlery utensils.

2. The dispenser of claim 1, wherein the at least one external helical thread comprises a plurality of external helical threads having a constant pitch over at least a portion of the threaded portion.

3. The dispenser of claim 1, wherein the at least one external helical thread comprises a plurality of external helical threads having a non-uniform pitch over at least a portion of the threaded portion.

4. The dispenser of claim 1, wherein the dispensing mechanism comprises a plurality of separating members each comprising:

an unthreaded portion configured to extend along the one or more first cutlery utensils; and a threaded portion comprising at least one external helical thread configured to engage the one or more second cutlery utensils.

5. The dispenser of claim 1, wherein the dispensing mechanism comprises at least one pair of separating members each comprising:

an unthreaded portion configured to extend along the one or more first cutlery utensils; and a threaded portion comprising at least one external helical thread configured to engage the one or more second cutlery utensils;

wherein the at least one pair of separating members is configured to engage the stack of cutlery utensils via opposing sides of the stack of cutlery utensils.

6. The dispenser of claim 1, wherein the circumferential flange is positioned at an end of the cylindrical body.

7. The dispenser of claim 1, wherein the circumferential flange is positioned at the top end.

8. The dispenser of claim 1, wherein the at least one separating member is configured to extend along the entire extent of the stack of cutlery utensils.

9. The dispenser of claim 3, wherein the non-uniform pitch of the plurality of external helical threads increases in a direction from the top end toward the bottom end.

10. The dispenser of claim 1, wherein the at least one separating member further comprises a gear positioned between the threaded portion and the bottom end.

11. The dispenser of claim 1, wherein at least one separating member is configured to support the stack of cutlery utensils by imparting a force against a portion of at least one of the cutlery utensils.

12. The dispenser of claim 1, wherein at least one separating member is configured to support the stack of cutlery utensils by imparting a force against a handle portion of at least one of the cutlery utensils.

13. The dispenser of claim 1, wherein the at least one external helical thread comprises a plurality of external helical threads having a constant pitch over a first length of the threaded portion in a direction from the top end toward the bottom end and a non-uniform pitch over a second length of the threaded portion in the direction from the top end toward the bottom end, and wherein the second length is greater than the first length.

14. A method of dispensing cutlery from a dispenser, the dispenser comprising at least one separating member, the method comprising:

providing a plurality of cutlery utensils for dispensing;

indexing at least one separating member such that a cutlery utensil is separated from a stack of cutlery utensils by the at least one separating member, wherein the at least one separating member comprises:

a top end;

a bottom end positioned opposite the top end;

an unthreaded portion extending from the top end toward the bottom end and comprising a cylindrical body extending along one or more first cutlery utensils of the stack of cutlery utensils and a circumferential flange projecting from the cylindrical body, the cylindrical body having a first diameter, and the circumferential flange having a second diameter greater than the first diameter; and a threaded portion extending from the unthreaded portion toward the bottom end and comprising at least one external helical thread engaging one or more second cutlery utensils of the stack of cutlery utensils, the threaded portion having a minor diameter equal to the first diameter and a major diameter greater than the first diameter; and providing access to the cutlery utensil separated from the stack of cutlery utensils.

15. The method of claim 14, wherein indexing at least one separating member comprises indexing at least one pair of separating members positioned on opposing sides of the stack of cutlery utensils.

16. The method of claim 14, wherein providing a plurality of cutlery utensils comprises providing a plurality of separably coupled cutlery utensils.

17. The method of claim 14, wherein indexing at least one separating member is facilitated by a drive mechanism associated with the at least one separating member and configured to drive the at least one separating member.

18. The method of claim 14, wherein indexing at least one separating member provides a separating force to at least one cutlery utensil and a retaining force to at least one other cutlery utensil.

19. The method of claim 17, wherein the drive mechanism is engaged by activating an actuator operably coupled to the drive mechanism.

20. The method of claim 14, wherein indexing at least one separating member comprises rotating the at least one separating member such that a cutlery utensil is separated from the stack of cutlery utensils.

21. The method of claim 14, wherein providing a plurality of cutlery utensils for dispensing comprises providing at least one of a cartridge of cutlery utensils or a stack of separably coupled cutlery utensils.

22. A dispenser for dispensing cutlery, the dispenser comprising:

a housing;

a stack of cutlery utensils contained within the housing;

a dispensing mechanism comprising:

at least one separating member configured to separate a cutlery utensil from the stack of cutlery utensils, the at least one separating member comprising:

a top end;

a bottom end positioned opposite the top end;

an unthreaded portion extending from the top end toward the bottom end and comprising a cylindrical body extending along one or more first cutlery utensils of the stack of cutlery utensils and a circumferential flange projecting from the cylindrical body, the cylindrical body having a first diameter, and the circumferential flange having a second diameter greater than the first diameter; and a threaded portion extending from the unthreaded portion toward the bottom end and comprising at least one external helical thread engaging one or more second cutlery utensils of the stack of cutlery utensils, the threaded portion having a minor diameter equal to the first diameter and a major diameter greater than the first diameter; and a drive mechanism associated with the at least one separating member and configured to drive the at least one separating member; and a receptacle configured to receive the cutlery utensil separated from the stack of cutlery utensils.

* * * * *